US009742105B2

(12) United States Patent
Mikli et al.

(10) Patent No.: US 9,742,105 B2
(45) Date of Patent: Aug. 22, 2017

(54) PROTECTIVE COVER AND ELECTRICAL CONNECTOR HAVING A RADIATION WINDOW FORMED BY A PLURALITY OF RADIATION PASSAGES

(71) Applicants: Tyco Electronics Raychem GmbH, Ottobrunn (DE); TE Connectivity Germany GmbH, Bensheim (DE)

(72) Inventors: Norbert Mikli, Ebersberg (DE); Ladislaus Kehl, Munich (DE)

(73) Assignees: Tyco Electronics Raychem GmbH, Ottobrunn (DE); TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/334,733

(22) Filed: Oct. 26, 2016

(65) Prior Publication Data

US 2017/0117662 A1 Apr. 27, 2017

(30) Foreign Application Priority Data

Oct. 26, 2015 (EP) ..... 15191430

(51) Int. Cl.

| | |
|---|---|
| ***H01R 13/53*** | (2006.01) |
| ***H01R 13/6581*** | (2011.01) |
| ***H01R 13/52*** | (2006.01) |
| ***H01R 43/18*** | (2006.01) |

(52) U.S. Cl.

CPC ..... *H01R 13/53* (2013.01); *H01R 13/5213* (2013.01); *H01R 13/5216* (2013.01); *H01R 43/18* (2013.01)

(58) Field of Classification Search

CPC H01R 13/53; H01R 13/6581; H01R 13/6485; H01R 2101/00; H01R 13/17; H01R 13/7175

USPC ..... 439/181, 921, 910, 607.01, 607.58

See application file for complete search history.

(56) References Cited

U.S. PATENT DOCUMENTS

| | | | | |
|---|---|---|---|---|
| 3,870,892 | A * | 3/1975 | Fass | H01L 31/14 250/483.1 |
| 4,865,559 | A * | 9/1989 | Clabburn | H01R 13/53 439/281 |
| 4,982,079 | A * | 1/1991 | Yagyu | H01L 27/14665 250/208.1 |
| 7,144,279 | B2 * | 12/2006 | Zahnen | H01R 4/36 439/709 |
| 7,717,740 | B2 * | 5/2010 | Zahnen | H01R 13/5205 439/521 |
| 7,963,782 | B2 * | 6/2011 | Hughes | H01R 13/53 439/181 |
| 8,016,622 | B2 * | 9/2011 | Battle | H01R 4/2408 439/279 |

(Continued)

OTHER PUBLICATIONS

European search report, dated Mar. 30, 2016, 9 pages.

*Primary Examiner* — Gary Paumen
(74) *Attorney, Agent, or Firm* — Barley Snyder

(57) ABSTRACT

A protective cover and an electrical connector assembly having the protective cover are disclosed. The protective cover has a body formed of an at least partly transparent or translucent electrically insulating material and an opaque electrically conductive layer disposed on the body. The electrically conductive layer has a radiation window penetrable by optical radiation formed by a plurality of radiation passages.

18 Claims, 9 Drawing Sheets

(56) References Cited

U.S. PATENT DOCUMENTS

| | | | | |
|---|---|---|---|---|
| 8,128,423 | B2 * | 3/2012 | Borgstrom | H01H 1/0015 439/181 |
| 8,388,381 | B2 * | 3/2013 | Borgstrom | H01R 13/5216 439/626 |
| 9,315,148 | B2 * | 4/2016 | Schwenke | B60Q 3/0213 |
| 2006/0030203 | A1 * | 2/2006 | Ohi | G09F 3/00 439/488 |
| 2006/0110983 | A1 * | 5/2006 | Muench | H01R 35/00 439/660 |
| 2006/0209551 | A1 * | 9/2006 | Schwenke | B32B 27/08 362/503 |
| 2008/0064265 | A1 * | 3/2008 | Sterling | B29C 45/16 439/660 |
| 2009/0215307 | A1 * | 8/2009 | Hughes | H01R 13/53 439/489 |
| 2010/0093211 | A1 | 4/2010 | Sutter | |
| 2012/0021650 | A1 | 1/2012 | Borgstrom et al. | |
| 2012/0124820 | A1 * | 5/2012 | Low | H01R 24/564 29/593 |
| 2013/0032576 | A1 | 2/2013 | Rosenkrans et al. | |
| 2013/0206728 | A1 | 8/2013 | Martin et al. | |

* cited by examiner

PROTECTIVE COVER AND ELECTRICAL CONNECTOR HAVING A RADIATION WINDOW FORMED BY A PLURALITY OF RADIATION PASSAGES

CROSS-REFERENCE TO RELATED APPLICATION

This application claims the benefit of the filing date under 35 U.S.C. §119(a)-(d) of European Patent Application No. 15191430.6, filed on Oct. 26, 2015.

FIELD OF THE INVENTION

The present invention relates to a protective cover for an electric component, and more particularly, to a protective cover for a high-voltage electrical connector assembly.

BACKGROUND

Safety rules require that before maintenance work on medium voltage (MV) and high voltage (HV) equipment is carried out, the status of the equipment has to be checked. Medium voltage MV generally includes a voltage range of about 3 kV to about 50 kV, and high voltage HV generally includes a voltage range of about 50 kV to about 400 kV and higher. The equipment has to be de-energized and/or disconnected and then grounded. In order to avoid critical situations during grounding, the status of a contact pin of an electrical breaker has to be visually checked before the grounding connection is made. This is referred to as "visible disconnect". Known separable connectors in MV grids sometimes have to be pulled under load to perform the visible disconnect. This is a cumbersome operation, since a cable pulled from the connector must be handled with sticks to provide the required safety distance to life parts. Commonly, the cable has to be pulled forwardly out of a cable duct in order to position the cable at a prepared safe place. The general trend of using larger cable cross-sections renders handling the cable and the connector even more difficult.

The prior art includes easier methods of disconnecting a cable, such as to integrate a removable link such as a contact pin within the connector, the operator simply pulling this removable link with a suitable stick. An example of such an electrical connector assembly is described in U.S. Pat. No. 4,865,559 A. Such known separable MV connectors, however, are covered with an opaque electrically conductive outer screen for technical and safety reasons. Consequently, a visual check of the status of the removable link is not possible. U.S. Pat. No. 8,388,381 B2 discloses an electrical connector assembly having a visible open port provided in a connector body, wherein at least a portion of the insulative material inside the connector body is visible through the visible open port. Providing such an opening within the outer shield, however, has the problem that the electrically conductive layer is interrupted and that safety requirements regarding touch safety can no longer be met.

SUMMARY

An object of the invention, among others, is to provide a protective cover and an electrical connector assembly that allows optical radiation to penetrate an opaque electrically conductive shield, but at the same time does not impair the electrical functionality of the electrically conductive shield, and to provide a visible disconnect without compromising safety or deteriorating the technical functionality of the connector assembly. The disclosed protective cover has a body formed of an at least partly transparent or translucent electrically insulating material and an opaque electrically conductive layer disposed on the body. The electrically conductive layer has a radiation window penetrable by optical radiation formed by a plurality of radiation passages.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a protective cover and an electrical connector assembly having the protective cover. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
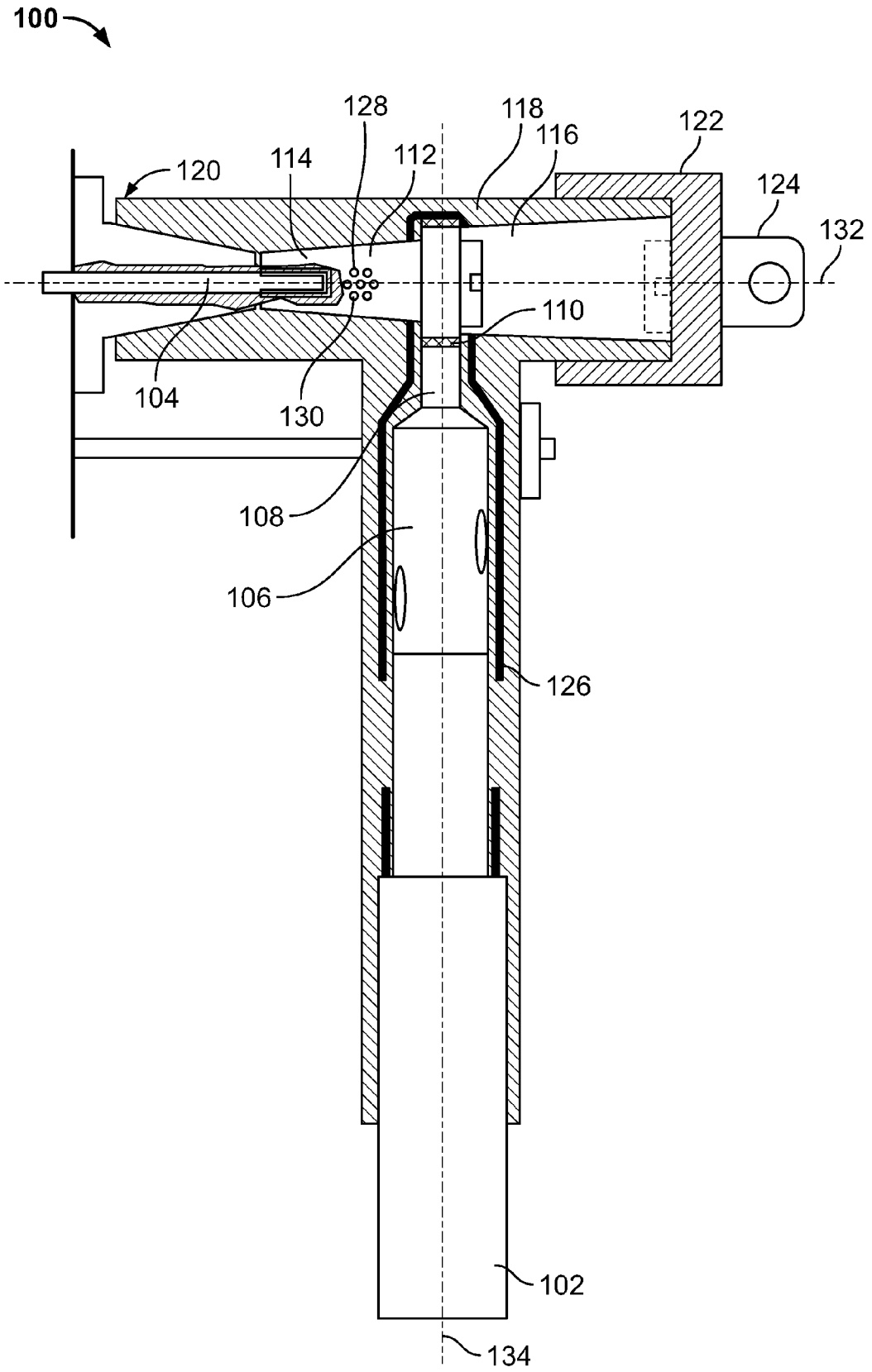
FIG. 1 is a sectional view of an electrical connector assembly according to the invention.

An electrical connector assembly 100 according to the invention is shown generally in FIG. 1. The electrical connector assembly 100 may be a disconnectable medium voltage (MV) dead break T-connector. Throughout the description, the term "high-voltage" is intended to refer to voltages above approximately 1 kV and the term "high-voltage cable" is intended to refer to a cable that is suitable for carrying electric current of more than about 1 A at a voltage above approximately 1 kV. Of course, higher voltages may also be included. These voltages may be direct current (DC) or alternating current (AC) voltages.

The electrical connector assembly 100, as shown in FIG. 1, establishes an electrical connection between a cable 102 and an equipment bushing 104, for instance for connecting a transformer. A conductive core of the cable 102 is introduced into a connector 106 which forms a first conductor receptacle.

Figure 2:
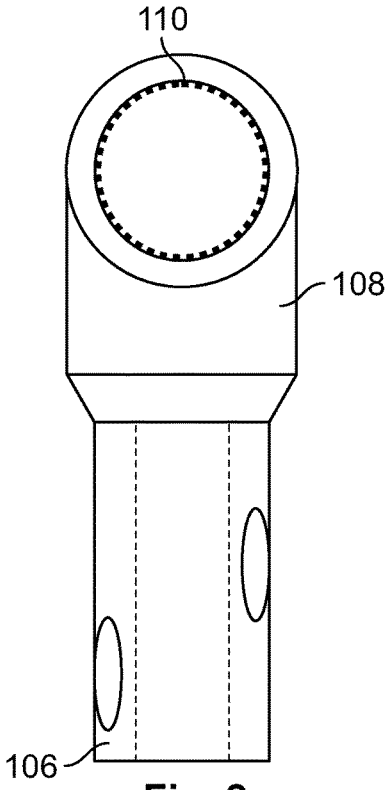
FIG. 2 is a side view of an electrically conductive inner part of the connector assembly of FIG. 1.
Figure 3:
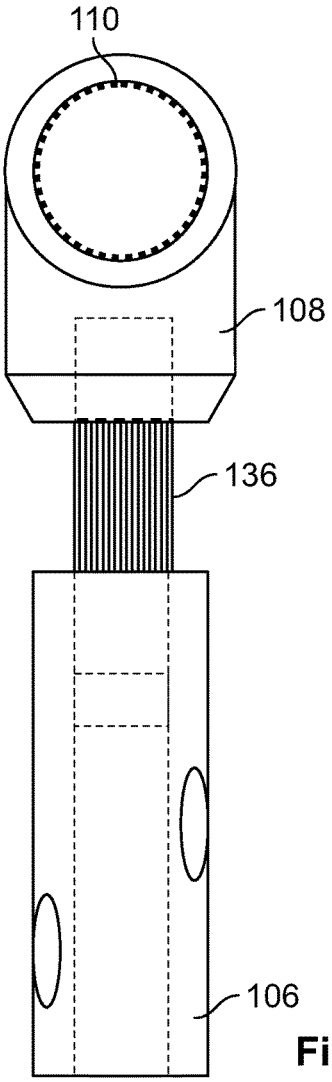
FIG. 3 is a side view of another electrically conductive inner part of the connector assembly of FIG. 1.

The connector assembly 100 comprises a ring contact 108 which electrically contacts a link 112 via a spring contact 110. FIGS. 2 and 3 show the connector 106 with its ring contact 108. The ring contact 108 as shown in FIG. 2 is connected to the conductor 106 in a rigid manner; alternatively, a semi-flexible connection 136 may be provided as shown in FIG. 3.

Figure 5:
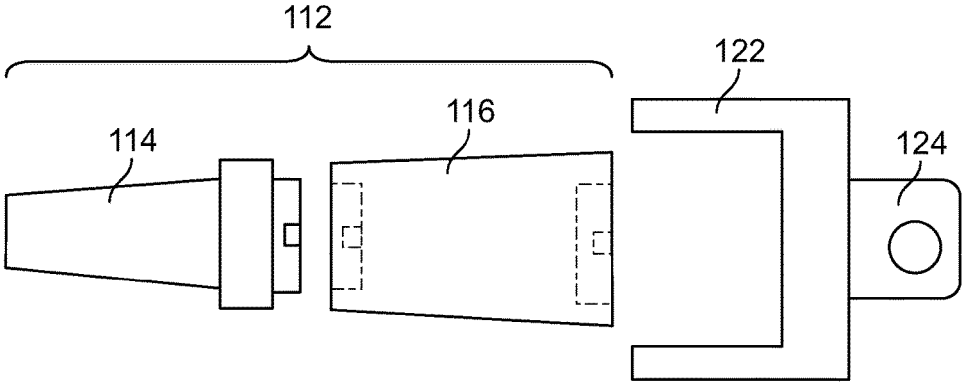
FIG. 5 is a side view of a link of the connector assembly of FIG. 1.

The link 112 is removable and may be exchanged according to the desired application. As shown in FIG. 1, the link 112 has an electrically conductive bridge 114 which establishes an electrical contact between the spring contact 110 of the connector 106 and the equipment bushing 104. The link 112 further comprises a first insulating plug 116 for covering the conductive bridge 114, as shown in FIGS. 1 and 5.

The connector assembly 100 also has a protective cover 118, 120 including a body 118 and an electrically conductive layer 120. The outer surface of the body 118 is covered with the electrically conductive layer 120. The body 118 is formed of an at least partly transparent or translucent electrically insulating elastomer, whereas the electrically conductive outer layer 120 is opaque.

The protective cover 118, 120 as shown in FIG. 1, has two opposing radiation windows 128 in a monitoring region. Each of the radiation windows 128 is formed by a plurality of radiation passages 130 extending through the electrically conductive layer 120. In the shown embodiment, a rotationally symmetric array of seven radiation passages 130 may form the radiation window 128, however, any other number and arrangement of radiation passages 130 is also possible. The radiation passages 130 are not required to have a circular cross-section, and may alternatively have a rectangular, polygonal, oval, or triangular cross-section.

Figure 4:
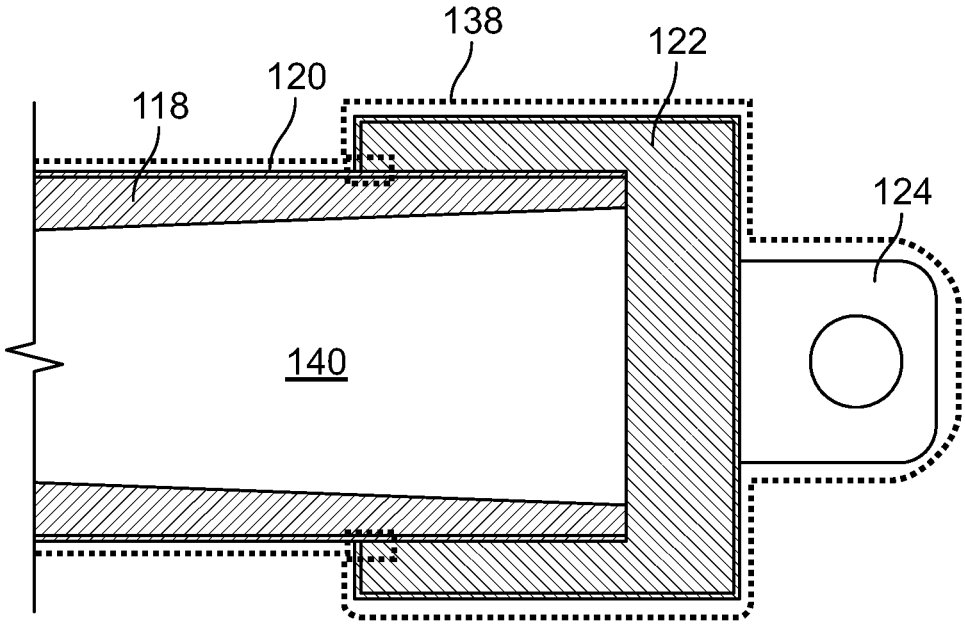
FIG. 4 is a sectional view of a sealing cap of the connector assembly of FIG. 1.

A sealing end cap 122 is provided for closing the connector assembly 100. The end cap 122 has a connecting lug 124 for attaching a grounding cable. As shown in FIG. 4, the end cap 122 and the body 118 are both fabricated from an electrically insulating material and are both covered by the electrically conductive outer layer 120 (not to scale in its thickness). By providing a tight press-fit with a sufficiently large overlap between the body 118 and the end cap 122, an outer earth current path 138 will not reach into an inner region 140 of the body 118. Instead, the earth current path 138 safely reaches the grounding lug 124. A further grounding connection may be provided at the body 118.

As further shown in FIG. 1, field control and faraday cage elements 126 are disposed around the connector 106, the ring contact 108, the spring contact 110, and portions of the link 112.

As shown in FIG. 1, the electrically conductive bridge 114 is opaque and therefore blocks a radiation path extending perpendicular to a longitudinal axis 132 and between two opposing radiation windows 128. Consequently, radiation that is emitted into a first of the radiation windows 128 cannot reach the second radiation window and will therefore not be detected; the situation of an established electrical connection between the cable 102 and the equipment bushing 104 is indicated by the absence of detected radiation. On the other hand, if the conductive bridge 114 is not present or is replaced by a link 112 having an electrically insulating part which is transparent or translucent, transmitted radiation may penetrate the electrical connector assembly 100 from one radiation window 128 to the opposing radiation window 128 and can be detected by a suitable detecting means or visually by a human operator. In other words, the presence of detectable radiation indicates the absence of the electrically conductive bridge 114. The electrical connector assembly 100 permits a visible disconnect.

Figure 6:
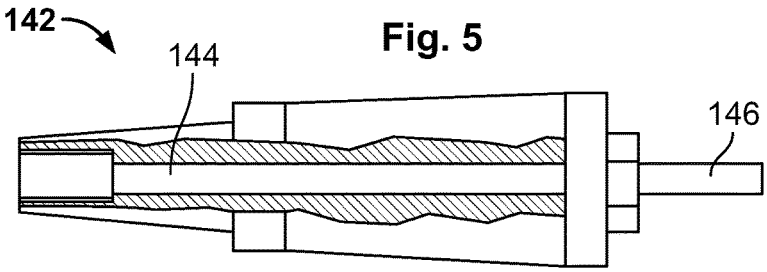
FIG. 6 is a side view of a second link of the connector assembly of FIG. 1.
Figure 7:
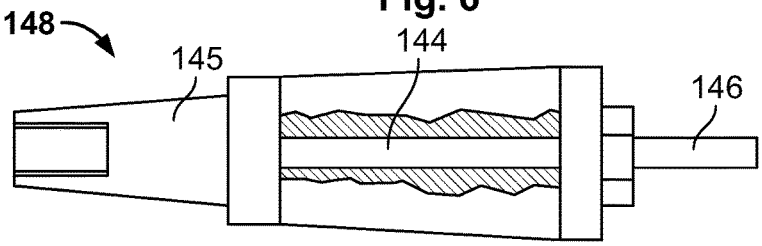
FIG. 7 is a side view of a third link of the connector assembly of FIG. 1.
Figure 8:
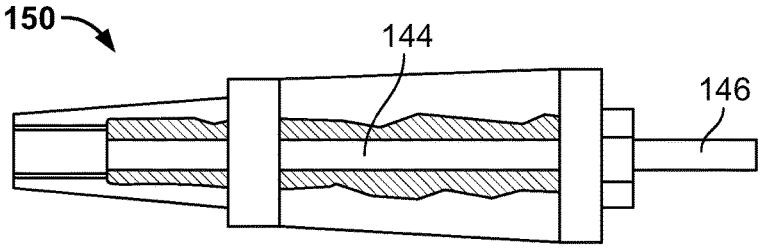
FIG. 8 is a side view of a fourth link of the connector assembly of FIG. 1.
Figure 9:
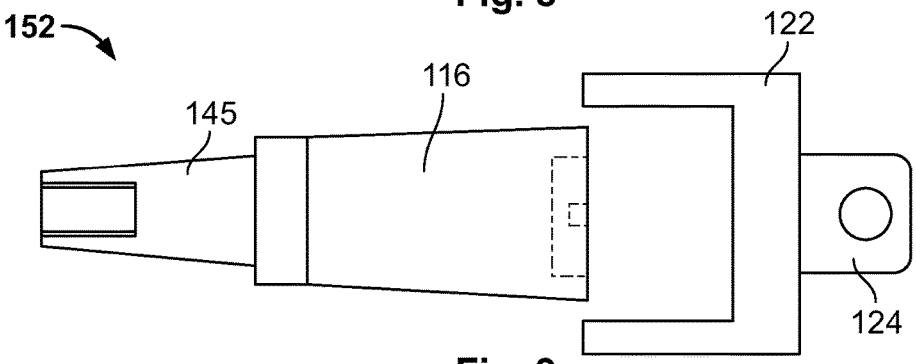
FIG. 9 is a side view of a fifth link of the connector assembly of FIG. 1.

Other embodiments of the link 112 are shown in FIGS. 6-9. A second link 142 shown in FIG. 6 provides an electric connection 144 from the equipment bushing 104 to a fixed grounding connector 146. By mounting the second link 142 instead of the first link 112, the equipment bushing 104 can be connected to ground. The end cap 122 is not used with the links shown in FIGS. 6 to 8, and the grounding of the body 118 outer surface is only provided by the above mentioned further grounding connection at the body 118. A third link 148 as shown in FIG. 7 may be provided that is mounted to connect the cable 102 via an electric connection 144 to a grounding connector 146. A second electrically insulating and transparent or translucent plug 145 is provided at the interface to the equipment bushing 104. A fourth link 150 shown in FIG. 8 forms an electrical connection 144 connecting the equipment bushing 104 as well as the cable 102 with the grounding connector 146. In contrast to the electrically conductive links 112, 142, 148, 150 shown in FIGS. 5 to 8, FIG. 9 shows a completely insulating fifth link 152. The fifth link 152 is a combination of the first and second insulating plugs 116, 145. At least the second insulating plug 145 is formed from a transparent or translucent material, such as an elastomer like the one forming the body 118. Referring back to FIG. 1, it can be seen that an unobstructed radiation path for radiation incident through a radiation window 128 is only provided in the case where the links 148 and 152 are mounted which have a transparent or translucent insulating second plug. These are also the situations where no electrical connection exists between the equipment bushing 104 and the cable 102, in other words, the safely disconnected states.

Figure 10:
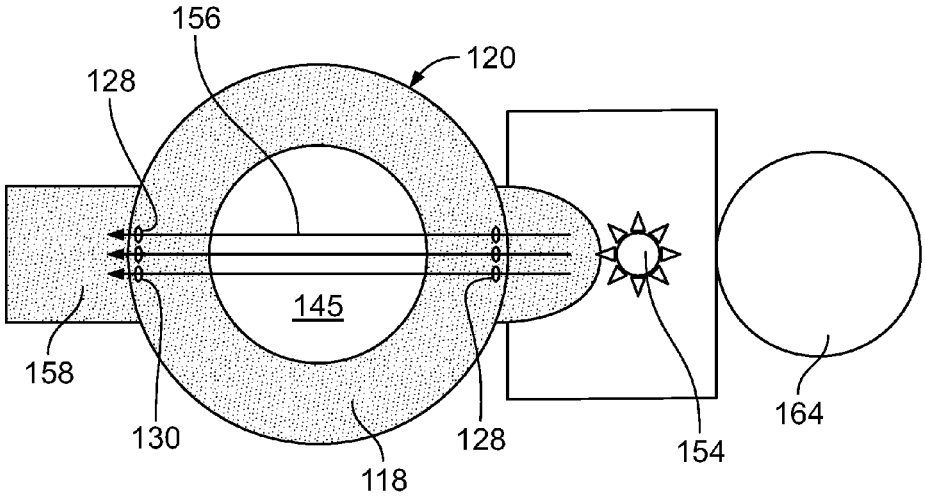
FIG. 10 is a front sectional view of an arrangement for detecting a disconnected state of the connector assembly of FIG. 1.
Figure 11:
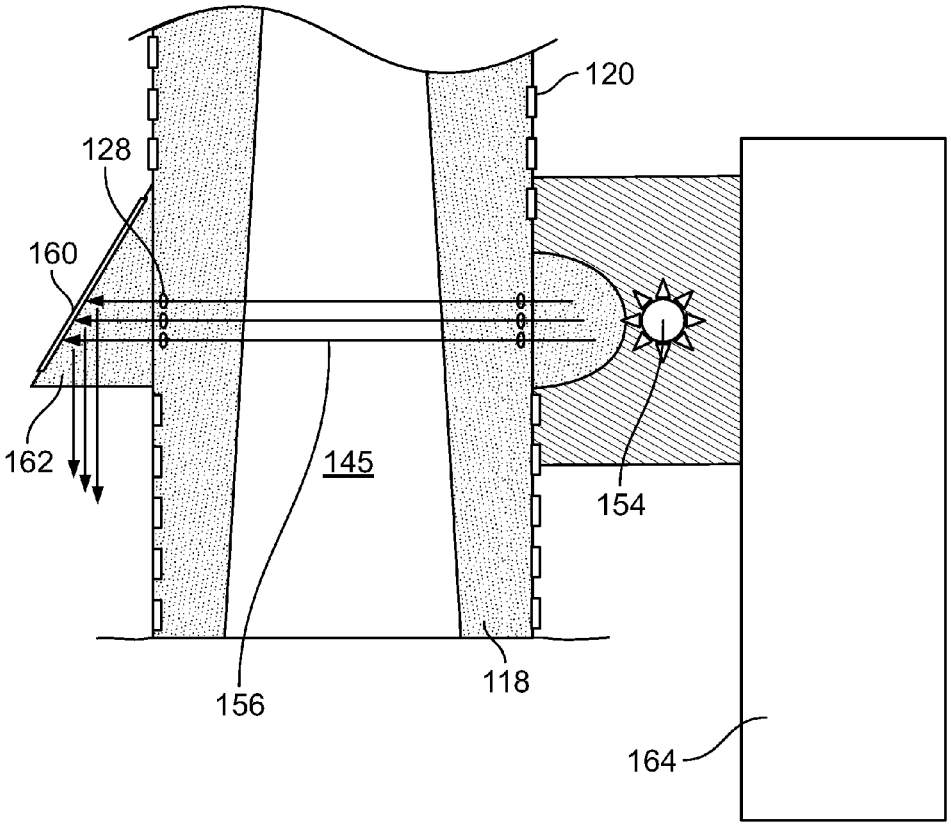
FIG. 11 is top sectional view of the arrangement of FIG. 10.

FIGS. 10 and 11 show an arrangement for determining the safe disconnect of the electrical connector assembly 100. As described above, the actual measurement is performed in the monitoring region of the connector assembly 100 shown in FIG. 1, where, depending on the connection state of the connector assembly 100, either a radiation path obstructing electrically conductive bridge 114 or a translucent/transparent insulating plug 116, 145 is mounted.

When it has to be determined whether an insulating plug 116, 145 is inserted and whether therefore the connector assembly 100 is in a safely disconnected state, a radiation source 154 is brought into close proximity of a first of the radiation windows 128 to transmit radiation into the body 118. The radiation source 154 may for instance be formed by one or more light emitting diodes (LED), a laser, or an incandescent light source. Suitable radiation shaping means, such as lenses, mirrors, or the like may of course additionally be provided.

A radiation beam 156 of the radiation source 154 passes through the radiation passages 130 within the opaque outer insulation layer 120, penetrates the translucent or transparent material of the body 118, and passes through the insulating plug 116, 145. At the opposing side of the body 118 a second radiation window 128 is provided through which the radiation beam 156 may exit. At the second radiation window 128, detection means 158 are provided for detecting the presence of an emerging radiation beam 156. Suitable detection means 158 may for instance comprise a photodiode or a CCD (charge-coupled device) unit. Alternatively, it may also be sufficient that a human operator directly and visually controls the radiation window 128.

In the embodiment shown in FIG. 11, a mirror 160 is attached to the second radiation window 128 for deflecting the radiation beam 156. In this manner an operator can more easily control whether a light beam is visible through the second radiation window 128 or not. The mirror 160 may be attached to the outside of the connector 100 by means of a transparent light guiding structure 162. The light guiding structure 162 and the mirror may be an integral part of the body 118 and may be attached to its surface by means of any suitable techniques, such as gluing or welding.

In order to meet the respective safety regulations for high-voltage equipment, the radiation source 154 may be mounted on a suitable stick 164. However, a light source 154 may also be permanently attached to the outer surface of the body 118.

An embodiment of a high-voltage electrical connector assembly 100 having the radiation window 128 formed from a plurality of radiation passages 130 is described above with reference to FIGS. 1-11, however, the principle of piecing together a plurality of radiation passages 130 to form a radiation window 128 can be applied to any sort of protective cover 118, 120 comprising a transparent or translucent insulating body 118 and an opaque electrically conductive layer 120.

Figure 12:
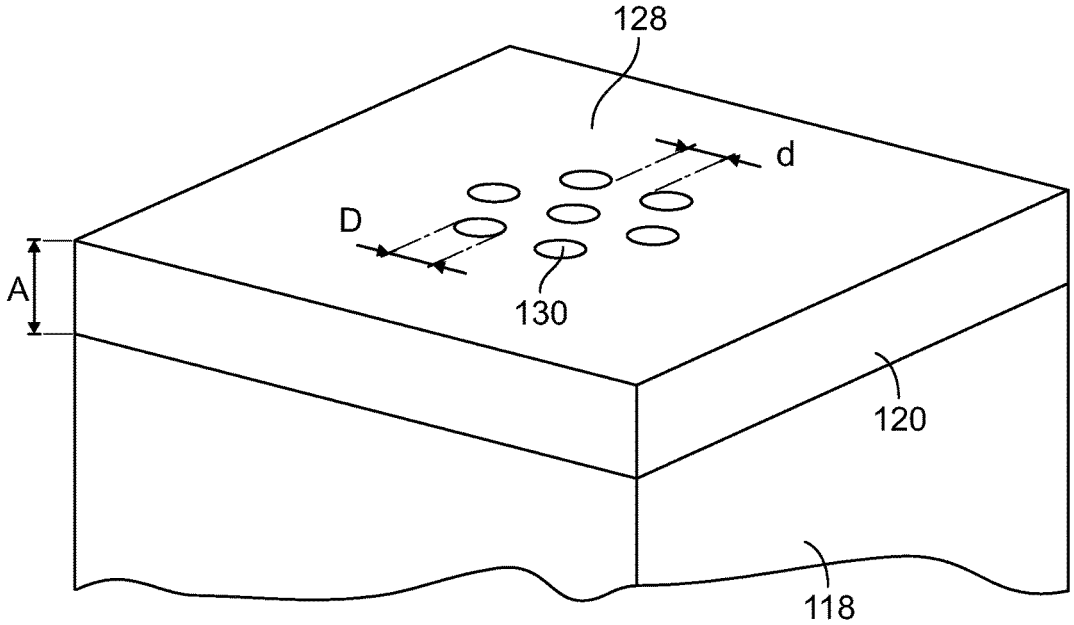
FIG. 12 is a perspective view of a portion of a protective cover of the connector assembly of FIG. 1.

FIG. 12 shows a small section of the protective cover 118, 120 with the body 118 and the electrically conductive opaque layer 120 functioning as a screen. The radiation window 128 is formed in the opaque layer 120 by an array of seven radiation passages 130. Each of the passages 130 is formed by an opening in the electrically conductive opaque layer 120 which is filled by a transparent or translucent material. The diameter D of the radiation passages 130 lies in the range of between 0.5 to 2.5 mm. This value essentially depends on the electrical fields that have to be handled and on the thickness A of the electrically conductive layer 120. It is essential that the electrical field cannot reach outside through the radiation passages 130. For higher values of the thickness A also larger diameters D are possible. The distance d between two adjacent radiation windows 128 should be larger than the respective diameter D in order to ensure that the electrically conductive layer 120 provides a sufficient covering and electrical conductivity. For instance, values from 0.8 mm to 4.0 mm may be chosen.

Figure 13:
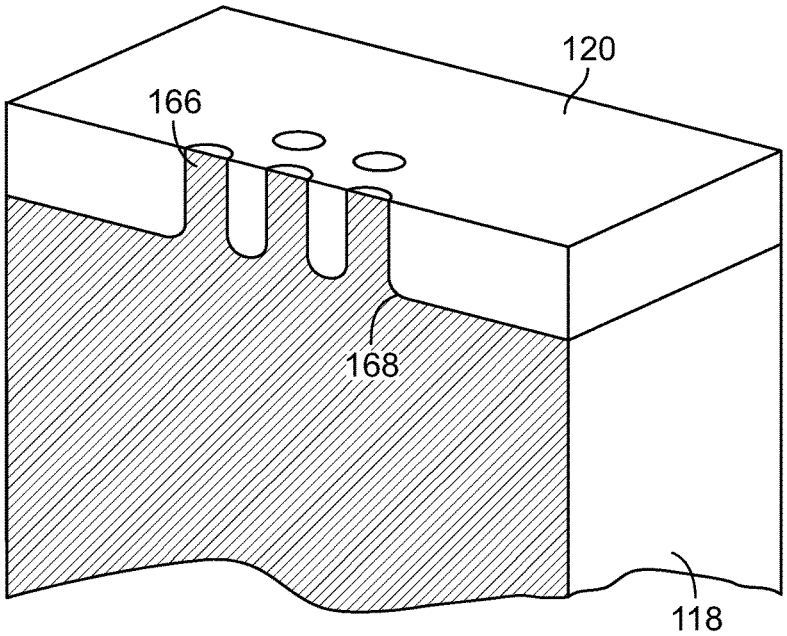
FIG. 13 is a perspective sectional view of the protective cover of FIG. 12.

As shown in FIG. 13, the electrically insulating transparent (or translucent) material that fills the radiation passages 130 is formed by pillar-shaped protrusions 166 (which also may be referred to as "burls") fabricated from the same material as the body 118. These pillar-shaped protrusions 166 on the one hand provide an electrically insulating and optically conductive filling for the radiation passages 130. On the other hand, the protrusions 166 act as spacers and define the openings in the opaque layer 120 when the opaque layer is fabricated by overmolding the body 118 with the protrusions 166 provided thereon. Each of the pillar-shaped protrusions 166 has a rounded base 168 at the transition to the bulk material of the body 118 in order to avoid sharp edges at the interface between the electrically conductive layer 120 and the electrically insulating body 118. Such a field control is advantageous for avoiding partial discharges at this interface.

Figure 14:
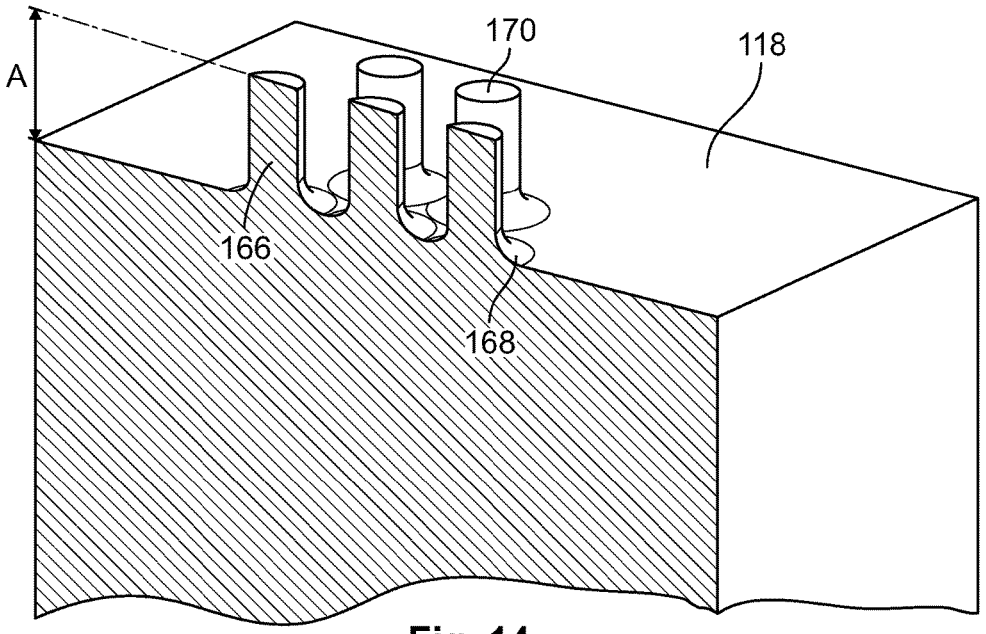
FIG. 14 is a perspective sectional view of the protective cover of FIG. 12 before overmolding with an electrically conductive layer.
Figure 15:
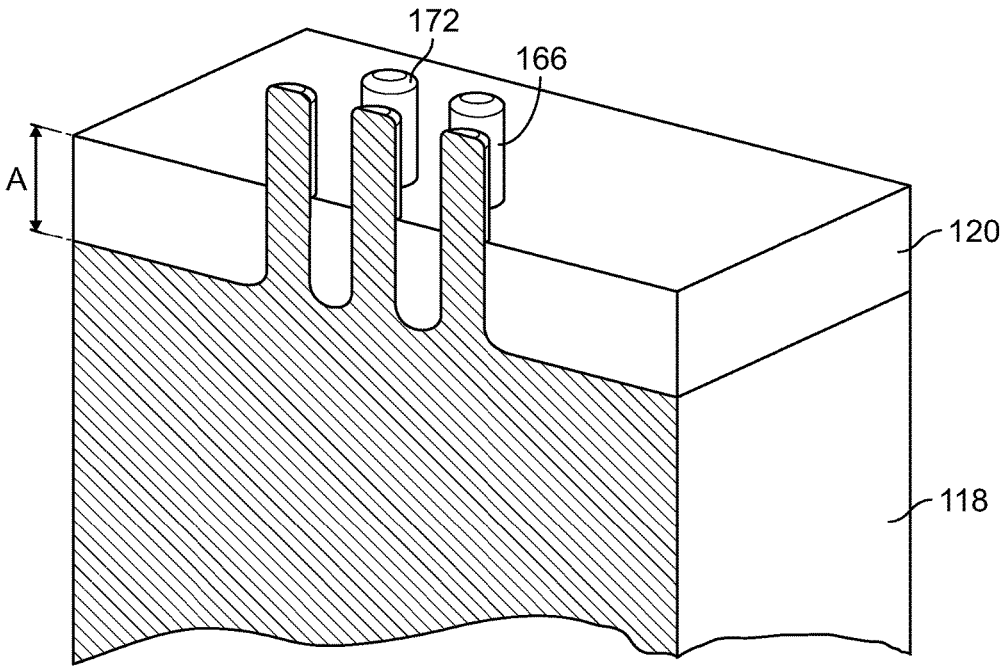
FIG. 15 is a perspective sectional view of the protective cover of FIG. 14 after overmolding with the electrically conductive layer.
Figure 16:
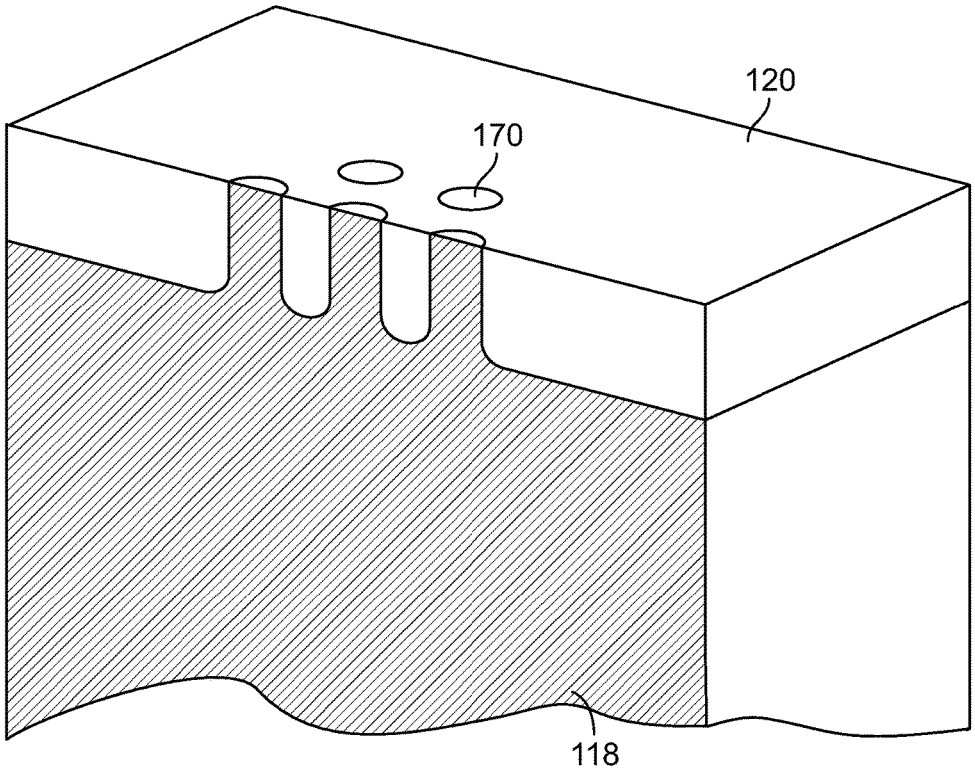
FIG. 16 is a perspective sectional view of the protective cover of FIG. 15 after removing excess material.

FIG. 14 shows the body 118 after a mold has been removed and before the electrically conductive opaque layer 120 is added. According to this embodiment, the pillar-shaped protrusions 166 are formed to have the same height A as the electrically conductive opaque layer 120. However, problems may occur due to a contamination of the upper surfaces 170 of the pillar-shaped protrusions 166 by undesired residues of the opaque material because the surfaces 170 are the optically active surfaces of the radiation window 128 and will be obscured by any opaque deposits. Consequently, as shown in FIG. 15, the pillar-shaped protrusions 166 are formed to be longer than the final length A. Moreover, the distal ends of the pillar-shaped protrusions 166 are provided with a convex surface 172. Such a convex surface 172 facilitates removing the mold without damaging the mechanically fragile structures of the pillar-shaped protrusions 166 and, furthermore, reduces the amount of opaque material that is deposited on top of the pillar-shaped protrusions 166 when applying the electrically conductive layer 120. According to this embodiment, the excess length of the pillar-shaped protrusions 166 which is protruding from the surface of the fully annealed electrically insulating layer 120 is removed by a mechanical abrasion step, resulting in completely clean active surfaces 170 of the protective cover 118, 120 as shown in FIG. 16.

Figure 17:
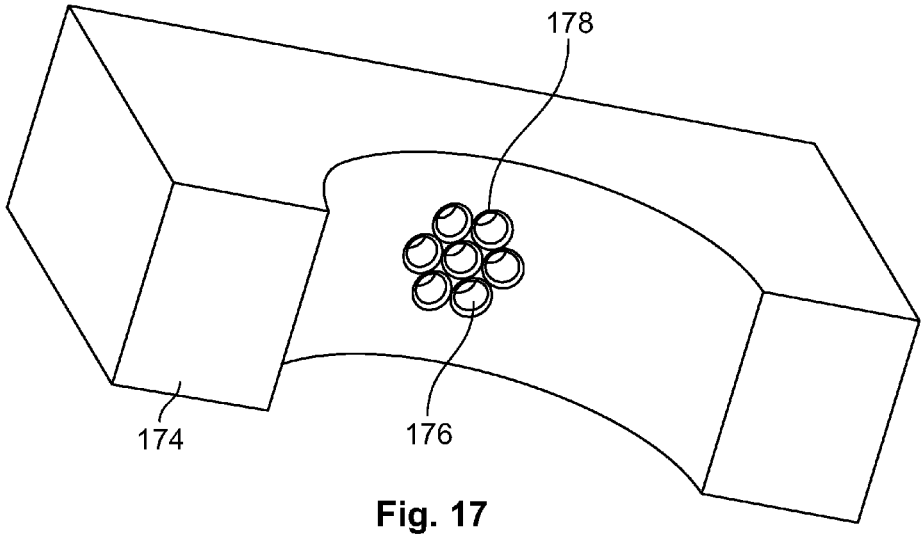
FIG. 17 is a perspective view of a mold for fabricating the protective cover of FIG. 12.

For fabricating the body 118 with protrusions 166 as described above, a mold 174 as shown in FIG. 17 has respective cavities 176. Depending on whether a radiation window 128 is provided at the opposing side of the body 118, the corresponding second half of the mold 174 may have a similar array of cavities 176. The cavities 176 may be formed as cylindrical bores. Pistons (also referred to as "stuffer pins") which are not shown in the Figures may be inserted from the outside of the mold 174 in order to push back the mold compound once the cavities 176 are filled. By correspondingly shaping the pistons, a particular form of the end region of the pillar-shaped protrusions 166 can be achieved. For instance, a concave piston produces a cavity 176 creating a convex shape of the upper end of the pillar-shaped protrusions 166. The mold 174 also has rounded or chamfered shoulders 178 at the end regions of the cavities 176 in order to form the above-mentioned rounded bases 168 of the pillar-shaped protrusions 166. These chamfered shoulders 178 are mirrored by a chamfered region of the electrically conductive opaque layer 120.

Figure 18:
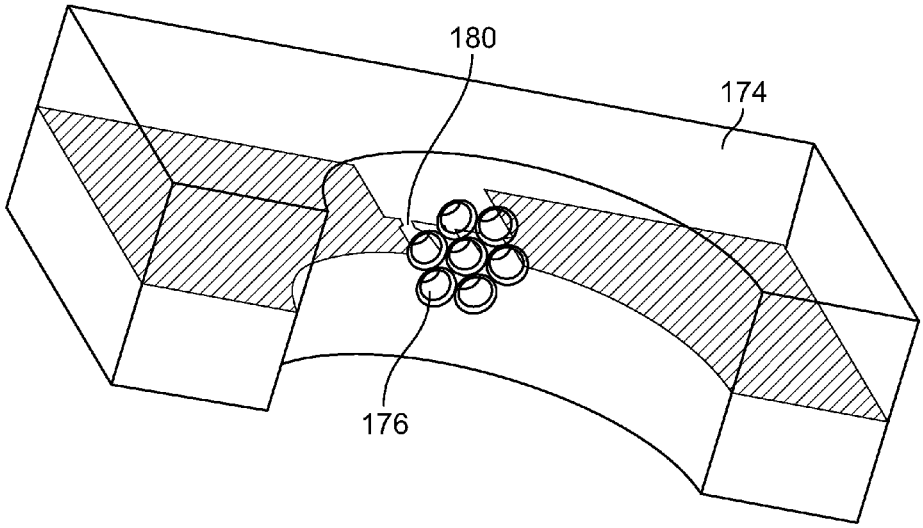
FIG. 18 is a perspective view of cavities of the mold of FIG. 17.

Another embodiment of the cavities 176 of the mold 174 is shown in FIG. 18. Venting apertures 180 are provided at the end of the cavities 176 that forms the upper end of the pillar-shaped protrusions 166. Such venting apertures 180 facilitate a bubble free filling of the cavities 176. The resulting pillar-shaped protrusions 166 are again slightly longer than the thickness A of the electrically conductive opaque layer 120 shown in FIGS. 14 and 15, so that the final optically active surfaces 170 can be made planar and free of burr by an additional machining process.

With reference to FIGS. 12-18, the individual method steps for fabricating a protective cover 118, 120 for instance for use in an electrical connector assembly 100, will be explained in the following.

First, the mold 174 is pieced together from at least two separable parts, as shown in FIG. 18, and is filled with a liquid precursor of a transparent or translucent electrically insulating material for forming the body 118. This may, for instance, be a transparent or translucent elastomer such as ethylene propylene diene monomer ("EPDM") or silicone rubber. An array of the cavities 176, which are provided in at least one region of the mold 176, are filled with the insulating material to form the pillar-shaped protrusions 166 which have a length at least equal to the thickness A of the electrically conductive opaque layer 120.

After the electrically insulating compound has cured completely, the mold 174 is removed.

Next, the electrically insulating body 118 comprising the pillar-shaped protrusions 166 is overmolded with a further elastomeric compound, which is electrically conductive and opaque, in order to form the electrically conductive opaque layer 120. The pillar-shaped protrusions 166 thus form spacers that define the insulator filled openings constituting the radiation passages 130 according to the present invention.

Lastly, after the electrically conductive opaque layer 120 is fully cured, an optional machining step can be performed for removing any undesired excess material at the pillar-shaped protrusions 166. Thereby, smooth and clean optically active surfaces 170, as shown in FIG. 16, can be provided.

Advantageously, in the protective cover 118, 120 of the connector assembly 100 according to the invention, by arranging the plurality of radiation passages 130 adjacently to each other, an array of openings is formed that has an electric functionality similar to a mesh or grid forming a Faraday cage: optical radiation is able to permeate the electrically conductive layer 120, whereas the electric screening effect is not impaired. Consequently, all safety requirements, in particular regarding touch protection, can be fulfilled. The protective cover 118, 120 can also be fabricated in a particularly simple and cost-efficient way, and does not need any additional parts. The radiation window 128 is also formed from the same material as the rest of the body 118, so that the window 128 also exhibits the same elastic characteristics and identical thermal behavior, leading to a higher robustness and mechanical stability.

What is claimed is:

1. A protective cover, comprising:

a body formed of an at least partly transparent or translucent electrically insulating material; and an opaque electrically conductive layer disposed on the body, the electrically conductive layer having a radiation window penetrable by optical radiation formed by a plurality of radiation passages.

2. The protective cover of claim 1, wherein the plurality of radiation passages are formed by a plurality of openings in the electrically conductive layer which are filled with a transparent or translucent material.

3. The protective cover of claim 2, wherein the transparent or translucent material filling the plurality of openings is a part of the body.

4. The protective cover of claim 3, wherein the electrically conductive layer has a chamfered region at an interface with the transparent or translucent material.

5. The protective cover of claim 1, wherein the protective cover has a first radiation window and a second radiation window radially opposed to each other along a longitudinal axis of the protective cover.

6. The protective cover of claim 1, wherein a smallest distance between two adjacent radiation passages of the plurality of radiation passages is larger than a diameter of the plurality of radiation passages.

7. The protective cover of claim 6, wherein the diameter of the plurality of radiation passages is between 0.5 to 2.5 mm and the smallest distance between two adjacent radiation passages is between 0.8 to 4.0 mm.

8. A method of manufacturing a protective cover, comprising:

molding an at least partly transparent or translucent electrically insulating body; and forming an opaque electrically conductive layer on a first surface of the body, the electrically conductive layer having a radiation window penetrable by optical radiation formed by a plurality of radiation passages.

9. The method of claim 8, wherein the molding step comprises molding a plurality of pillar-shaped protrusions on the body in a mold having a plurality of cavities.

10. The method of claim 9, wherein the forming step comprises overmolding the body with an electrically conductive opaque material, the plurality of pillar-shaped protrusions forming the plurality of radiation passages.

11. The method of claim 10, wherein the molding step comprises forming a convex surface on an end of each of the plurality of pillar-shaped protrusions.

12. The method of claim 10, wherein each of the plurality of pillar-shaped protrusions is further formed by a piston inserted into each of the plurality of cavities.

13. The method of claim 10, further comprising a step of removing a portion of the plurality of pillar-shaped protrusions extending above the electrically conductive layer.

14. An electrical connector assembly, comprising:

a protective cover having a body formed of an at least partly transparent or translucent electrically insulating material and an opaque electrically conductive layer disposed on the body, the electrically conductive layer having a radiation window penetrable by optical radiation formed by a plurality of radiation passages;

a cable;

an equipment bushing; and a first link removably disposed in the protective cover electrically connecting the cable and the equipment bushing.

15. The electrical connector assembly of claim 14, wherein the protective cover has a first radiation window and a second radiation window radially opposed to each other along a longitudinal axis of the protective cover.

16. The electrical connector assembly of claim 14, further comprising a second link removably disposed in the protective cover electrically insulating the cable from the equipment bushing.

17. The electrical connector assembly of claim 14, further comprising a third link removably disposed in the protective cover electrically insulating the cable from the equipment bushing and connecting the cable to a grounding connector.

18. A method for monitoring the connected status of an electrical connector assembly, comprising:

providing an electrical connector assembly comprising a protective cover having a body formed of an at least partly transparent or translucent electrically insulating material and an opaque electrically conductive layer disposed on the body, the electrically conductive layer having a first radiation window and a second radiation window penetrable by optical radiation formed by a plurality of radiation passages, a cable, an equipment bushing, and a link removably disposed in the protective cover electrically connecting the cable and the equipment bushing;

transmitting optical radiation through the first radiation window; and detecting, only when the link is removed from the protective cover, the optical radiation at the second radiation window.

* * * * *